US008598443B2

(12) United States Patent
May

(10) Patent No.: US 8,598,443 B2
(45) **Date of Patent: *Dec. 3, 2013**

(54) CARRIER ASSEMBLY FOR PERCUSSION INSTRUMENTS

(76) Inventor: Randall L May, Irvine, CA (US)

( * ) Notice: Subject to any disclaimer, the term of this patent is extended or adjusted under 35 U.S.C. 154(b) by 111 days.

This patent is subject to a terminal disclaimer.

(21) Appl. No.: 13/290,921

(22) Filed: Nov. 7, 2011

(65) Prior Publication Data

US 2012/0048096 A1 Mar. 1, 2012

Related U.S. Application Data

(60) Continuation-in-part of application No. 10/950,130, filed on Sep. 27, 2004, now Pat. No. 7,673,776, which is a continuation-in-part of application No. 10/831,638, filed on Apr. 23, 2004, now Pat. No. 6,881,886, which is a continuation-in-part of application No. 10/374,676, filed on Feb. 26, 2003, now Pat. No. 7,071,401, which is a continuation-in-part of application No. 10/170,005, filed on Jun. 10, 2002, now Pat. No. 6,770,805, which is a division of application No. 09/756,479, filed on Jan. 8, 2001, now Pat. No. 6,403,869, which is a continuation-in-part of application No. 09/507,800, filed on Feb. 22, 2000, now Pat. No. 6,172,290, which is a division of application No. 09/497,265, filed on Feb. 3, 2000, now Pat. No. 6,323,407, application No. 13/290,921, which is a continuation-in-part of application No. 12/719,736, filed on Mar. 8, 2010, now Pat. No. 8,053,655.

(51) Int. Cl.
*G10D 13/02* (2006.01)

(52) U.S. Cl.
USPC ..... 84/421

(58) Field of Classification Search
USPC ..... 84/411 R, 421
See application file for complete search history.

(56) References Cited

U.S. PATENT DOCUMENTS

| | | | |
|---|---|---|---|
| 45,104 | A | 11/1864 | Weston |
| 909,217 | A | 1/1909 | Presba et al. |
| 1,179,063 | A | 4/1916 | Aldrete |
| 1,191,426 | A | 7/1916 | Huddle |
| 1,296,619 | A | 3/1919 | Bulat |
| 2,547,818 | A | 4/1951 | Gould |
| 2,717,109 | A | 9/1955 | Walsh |
| 4,256,007 | A | 3/1981 | Streit |
| 4,387,839 | A | 6/1983 | Dranchak |
| 4,402,441 | A | 9/1983 | Jines et al. |
| 4,453,442 | A | 6/1984 | LaFlame |
| 4,453,446 | A | 6/1984 | Hoshino |
| 4,605,144 | A | 8/1986 | LaFlame |
| 4,634,032 | A | 1/1987 | LaFlame |
| 4,796,508 | A | 1/1989 | Hoshino |

(Continued)

*Primary Examiner* — Kimberly Lockett
(74) *Attorney, Agent, or Firm* — Kirk A. Buhler; Buhler & Associates

(57) ABSTRACT

Drum hardware and drum secured thereon are preferably supported on a vest type carrier or a T-bar carrier having a plurality of separate parts removable from each other and formed of a rigid light material such as plastic or a light metal such as magnesium, aluminum or titanium. The carrier has a vest or belly plate, shoulder supports, and back bar and the shoulder supports are removable and/or adjustable. The supporting elements are of rod, tube, pipe or tubular construction. Special padding may be included on the shoulder supports, belly plate portion and other parts where cushioning is needed. The hardware may be universally adjustable.

20 Claims, 14 Drawing Sheets

(56) References Cited

U.S. PATENT DOCUMENTS

| | | | | |
|---|---|---|---|---|
| 4,799,610 | A | 1/1989 | Hesieh | |
| 5,400,683 | A * | 3/1995 | LaFlame | 84/421 |
| 5,464,137 | A | 11/1995 | Shirdavani | |
| 5,520,292 | A | 5/1996 | Lombardi | |
| 5,524,462 | A | 6/1996 | Loughlin | |
| 5,573,158 | A | 11/1996 | Penn | |
| D388,246 | S | 12/1997 | Patterson | |
| 5,806,734 | A | 9/1998 | Scott | |
| 5,973,247 | A | 10/1999 | Matthews | |
| 7,394,008 | B2 * | 7/2008 | May | 84/421 |
| 7,671,261 | B1 * | 3/2010 | Momose | 84/421 |

* cited by examiner

CARRIER ASSEMBLY FOR PERCUSSION INSTRUMENTS

CROSS REFERENCE TO RELATED APPLICATION

This application is a continuation-in-part of applicant's applications U.S. application Ser. No. 12/719,736 filed Mar. 8, 2010, now U.S. Pat. No. 8,053,655, issued Nov. 8, 2011, which claims the benefit of continuation-in-part of applicant's applications U.S. application Ser. No. 10/950,130 filed Sep. 27, 2004, now U.S. Pat. No. 7,673,776, issued Mar. 9, 2010, which claims the benefit of continuation-in-part of applicant's applications U.S. application Ser. No. 10/831,638 filed Apr. 23, 2004, now U.S. Pat. No. 6,881,886, issued Apr. 19, 2005, which claims the benefit of Continuation-in-part U.S. application Ser. No. 10/374,676 filed Feb. 26, 2003, now U.S. Pat. No. 7,071,401, issued Jul. 4, 2006, which claims the benefit of Continuation-in-part of application Ser. No. 10/170,005 filed Jun. 10, 2002, now U.S. Pat. No. 6,770,805, issued Aug. 3, 2004, which claims the benefit of Divisional U.S. application Ser. No. 09/756,479 filed Jan. 8, 2001, now U.S. Pat. No. 6,403,869, issued Jul. 11, 2002, which claims the benefit of Continuation-in-part U.S. application Ser. No. 09/507,800 filed Feb. 22, 2000, now U.S. Pat. No. 6,172,290, issued Jan. 9, 2001, which claims the benefit of Divisional U.S. application Ser. No. 09/497,265 filed Feb. 3, 2000, now U.S. Pat. No. 6,323,407, issued Nov. 27, 2001.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to new and useful improvements in apparatus for carrying percussion instruments, particularly drums of various kinds, cymbals, xylophones, and the like. More particularly, the present invention relates to a carrier hardware providing a novel articulating hinge assembly for the support for percussion instruments and to carrier assemblies supporting percussion instruments on a person while standing, walking or marching. The carrier assembly has a construction and relationship of parts to transfer the weight of the percussion instrument(s) to the body of a person. A clamp is located in the front of the carrier. The clamp allows the carrier to be folded for easier transportation and storage in a smaller space. The clamp can be loose to allow the linked parts to move freely, or the clamp can be locked to fix the linked parts in position. The person carrying the instruments maintains a stable attitude while walking or marching about and avoids pressure or other forms of detrimental forces on the shoulders and lower back and is further characterized by having removable and/or adjustable back support member or members. The adjustment to the back support member position may also be accomplished using a fixed back support member with adjustable shoulder supports. The back member may be secured to the shoulder supports and the shoulder supports may be removable and or adjustable to accommodate different sized users.

2. Description of Related Art including information disclosed under 37 CFR 1.97 and 1.98

The prior art discloses many examples of apparatus for supporting percussion instruments but none providing the combination of features disclosed and claimed herein.

La Flame U.S. Pat. No. 5,400,683 discloses a carrier for percussion instruments having an abdominal plate connected at one end of a unitary frame partly encircling the wearer at the waist and having an upstanding rear portion pivotally connected to a back pressure plate. Shoulder bars are connected to the back-pressure plate and wrap about shoulders and support supports connect to the abdominal plate.

Hsieh U.S. Pat. No. 4,799,610 shows a carrier for percussion instruments having a "T" bar, a pair of shoulder bars, a belly plate. The shoulder bars are bolted on a lateral plate of the "T" bar. The lateral plate has arc-like slots and spaced semi-circular holes permit bolts to slide in the slots. The fastening end of each shoulder bar has a hole and an arc-like slot from the upper portion to the lower portion permitting angular adjustment of the shoulder rightward or leftward for various applications.

La Flame U.S. Pat. No. 4,643,032 shows a carrier for various instruments such as marching bells, a marching xylophone or a marching marimba, which are supported on the apparatus by the use of suitably-constructed extension arms. The carrier frame is a U-shaped bent bar welded or otherwise attached to a belly plate and has extension arms which project from the belly plate to engage and support the instrument.

La Flame GB patent 2,123,676 (based on U.S. Pat. No. 4,453,442) discloses a carrier for percussion instruments or the like which includes the combination of a belly plate with a carrier bracket for supporting an instrument at an outwardly-overhung position about a fulcrum area of contact with the front waistline area of the person, a rigid band with a generally bent contour to extend along a portion of the waistline area of the person to the back of the person, a back-plate riser arm supported by the ban to extend in a generally upward direction such that a portion of the arm will extend along the back thoracic region of the person, and means carried by the arm for imparting to the thoracic back region of the person a reactive force to the overhung weight of the instrument about the aforesaid means forming a fulcrum area of contact with the person.

Dranchak U.S. Pat. No. 4,387,839 discloses a drum-supporting harness having two shoulder hooks with cushion pads or liners, a breast plate secured to the hooks, and a hanger structure attached to the breast plate and depending there from. Upwardly-facing hooks, a spacer bar extending downward from the hooks, and a spacing abutment carried by the spacer bar and extending forward there from are carried by the lower portion of the hanger structure. The hooks and the spacing abutment engage upper and lower portions of the body of the drum. The hanger structure is adjustable or extensible by means of overlapping strips which can be secured in a number of different positions. An adapter assembly attaches to the upper rim portion of the drum for connecting of hooks 16 to the drum.

Other possibly relevant prior art is Pyle U.S. Pat. No. 5,054,357 and the inventor's own patents May U.S. Pat. No. 5,072,910, May U.S. Pat. No. 5,300,810, May U.S. Pat. No.

6,028,257, May U.S. Pat. No. 5,691,492, May U.S. Pat. No. 6,329,583 and May U.S. Pat. No. 7,394,008 that are herein incorporated by reference.

The prior art discloses many examples of apparatus for supporting percussion instruments but none provide the combination of features that are disclosed and claimed herein.

BRIEF SUMMARY OF THE INVENTION

One object of the invention is to provide a new and improved carrier for percussion instruments comprising a novel T-bar carrier with belly plate, shoulder supports, and back bar in which the shoulder supports are removable and/or adjustable.

One object of the invention is to provide a new and improved carrier for percussion instruments comprising a novel supporting instrument carrier and a clamp having recesses to receive and clamp J-rods or posts around their peripheries in spaced relation on said carrier.

Another object of the invention is to provide a new and improved carrier for percussion instruments comprising a novel vest-type carrier with back bar and removable and/or adjustable shoulder supports.

Another object of the invention is to provide a new and improved carrier for percussion instruments having shoulder supports and an adjustable back bar.

Another object of the invention is to provide a new and improved carrier for percussion instruments comprising a novel T-bar carrier with belly plate, shoulder supports, and back bar, and a clamp having a recesses to receive and clamp J-rods or posts around their peripheries in spaced relation on said vest.

Still another object of the invention is to provide a new and improved carrier for percussion instruments in which the supporting elements are of rod or tubular construction.

Other objects of the invention will become apparent throughout the specification and claims as hereinafter related. Various objects, features, aspects, and advantages of the present invention will become more apparent from the following detailed description of preferred embodiments of the invention, along with the accompanying drawings in which like numerals represent like components.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Marching T-Bar Type Support for Drums and Other Percussion Instruments

Figure 1:
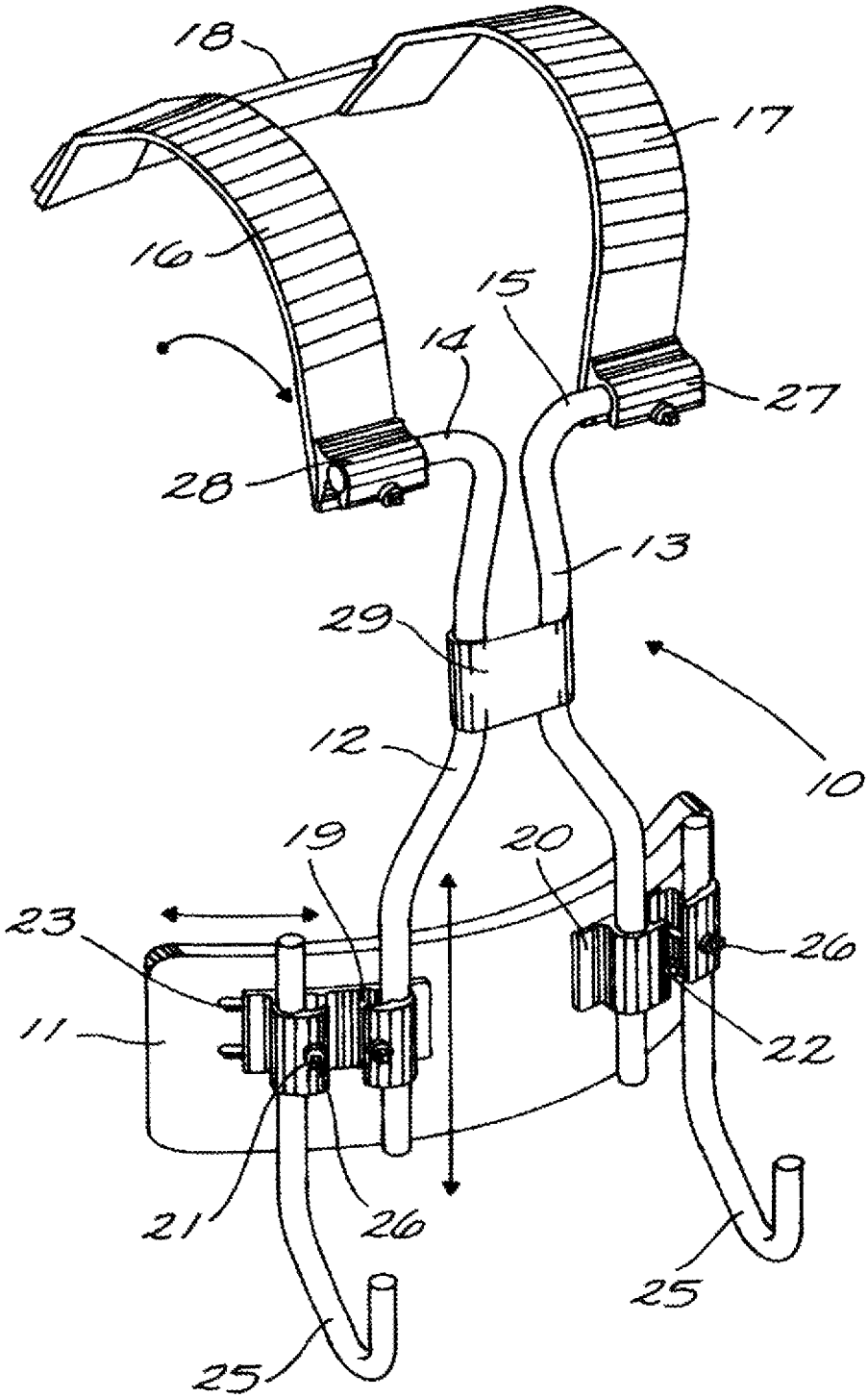
FIG. 1 is a front isometric view of hardware for supporting a drum in accordance with a preferred embodiment of the invention.
Figure 2:
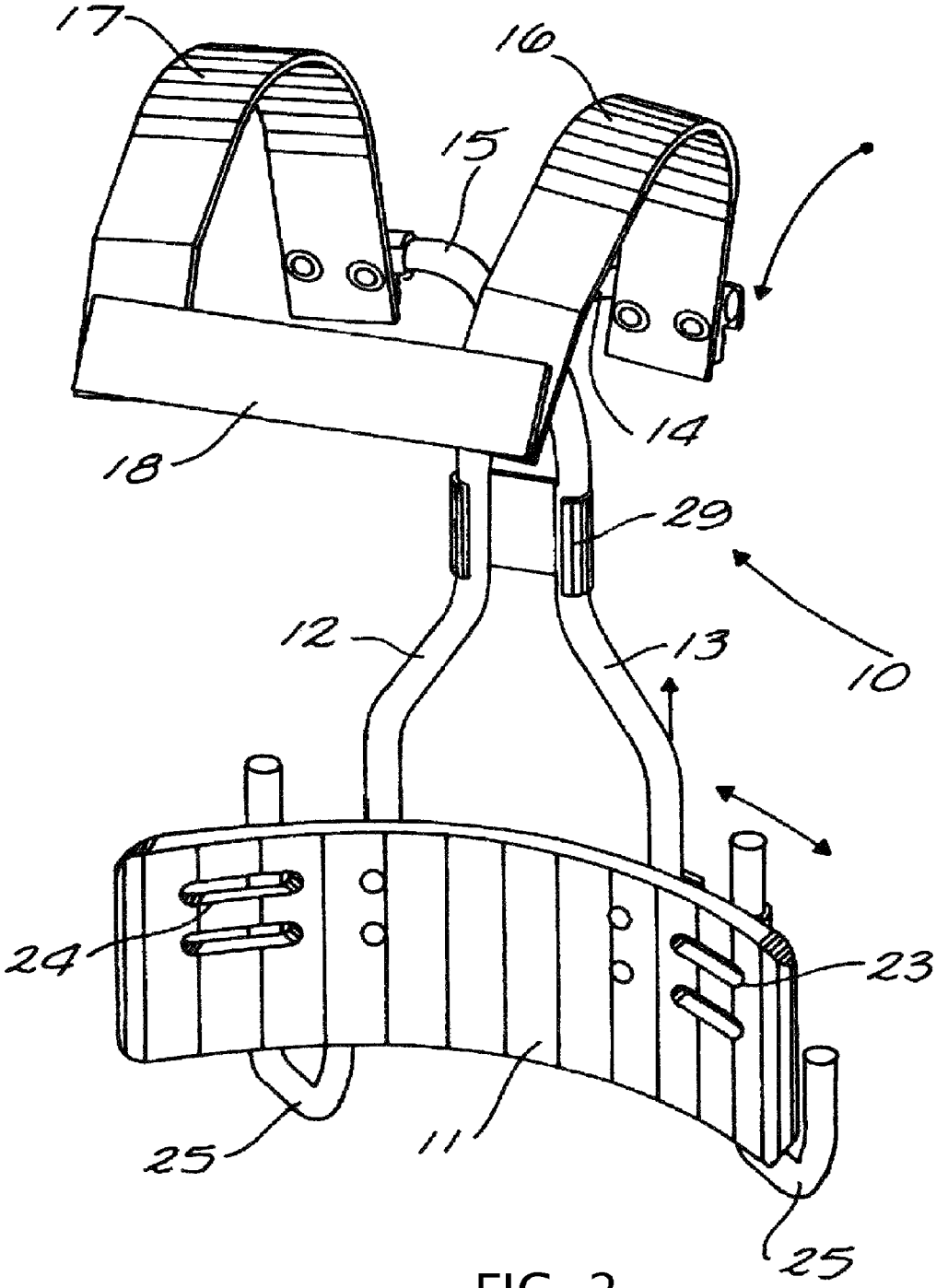
FIG. 2 is a rear isometric view of hardware for supporting a drum as shown in FIG. 1.

Referring to FIGS. 1 and 2, there is shown a T-bar-type carrier 10 for percussion instruments which comprises a belly plate 11, vertical supporting rods, tubes or pipes 12 and 13 having outturned portions 14 and 15 supporting rigid shoulder supports 16 and 17 and back bar 18. Back bar 18 may be removably secured to shoulder supports 18 or may be fixed as by welding or the like.

Belly plate 11 is removably secured on the lower ends of vertical rods, tubes or pipes 12 and 13 by clamping receptacles 19 and 20. J-rod receptacles 21 and 22 are secured on belly plate 11 in slots 23 and 24 by screws or bolts or the like. J-rods 25 are secured in receptacles 21 and 22 by bolts 26. The upper, out-turned ends 14 and 15 of supporting rods, tubes or pipes 12 and 13 are supported in clamping receptacles 27 and 28 on shoulder supports 16 and 17. A clamp 29 holds rods, tubes or pipes 12 and 13 against lateral and or torque displacement.

The materials of construction used in this carrier 10 are very important for achieving the desired result. The belly plate 11, vertical supporting rods, tubes or pipes 12 and 13, shoulder supports 16 and 17 and back bar 18 are rigid and made of a light material such as plastic or a light metal such as aluminum, magnesium or titanium. The metal shoulder supports have the advantage that different sizes are readily accommodated.

Operation

The operation of this carrier should be apparent but will be described briefly for clarity. The carrier 10 is worn by the musician with the shoulder supports 16 and 17 positioned over the shoulders and the belly plate 11 supported against the abdomen. J-rods 25 are inserted in position and secured in place by tightening bolts 26. The short outer ends of the J-rods 25 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacles 27 and 28 permit pivotal, lateral and angular adjustment of shoulder supports 16 and 17 on the out-turned ends 14 and 15 of rods, tubes or pipes 12 and 13. Clamp-receptacles 19 and 20 permit vertical sliding adjustment of rods, tubes or pipes 12 and 13. Slots 23 and 24 in belly plate 11 allow lateral adjustment of clamp-receptacles 21 and 22 and angular adjustment of J-rods supported therein.

Figures 3, 4:
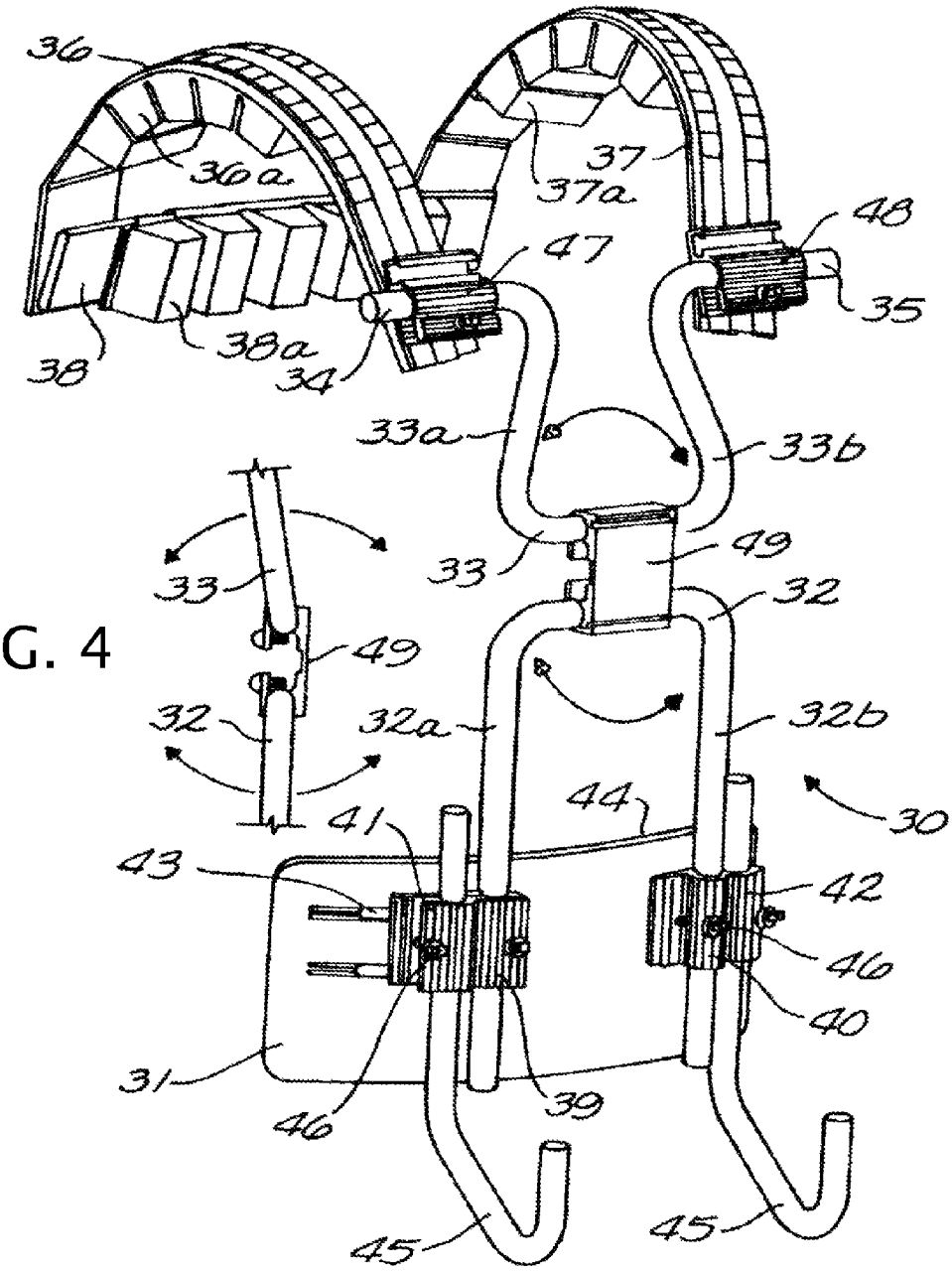
FIG. 3 is a front isometric view of hardware for supporting a drum and having vertical articulated supports in accordance with another embodiment of the invention.
FIG. 4 is a side view of the articulated joint in the hardware shown in FIG. 3.

An Articulated Embodiment of Marching T-Bar Type Support for Drums and Other Percussion Instruments Referring to FIG. 3, there is shown a T-bar-type carrier 30 for percussion instruments which comprises a belly plate 31, lower and upper vertical supporting rods, tubes or pipes 32 and 33. Lower rod or tube 32 is U-shaped with parallel portions 32*a* and 32*b* supporting belly plate 31. Upper rod or tube 33 is U-shaped with legs 33*a* and 33*b* having out-turned portions 34 and 35 supporting rigid shoulder supports 36 and 37 and back bar 38. Back bar 38 may be removably secured to shoulder supports 36 and 37 or may be fixed as by welding or the like. Shoulder supports 36 and 37 and back bar 38 have cushions 36*a*, 37*a* and 38*a*, respectively. The cushions are of a type used to pad the interior of football and other sports helmets and are shown in more detail in the inventor's U.S. Pat. No. 6,028,257. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded.

Belly plate 31 is removably secured on the lower ends 32*a* and 32*b* of vertical rod or tube 32 by clamping receptacles 39 and 40. J-rod receptacles 41 and 42 are secured on belly plate 31 in slots 43 and 44 by screws or bolts or the like. J-rods 45 are secured in receptacles 41 and 42 by bolts 46. The upper, out-turned ends 34 and 35 of supporting rod or tube 33 are supported in clamping receptacles 47 and 48 on shoulder supports 36 and 37. A clamp 49 holds rods, tubes or pipes 32 and 33 in an articulated relation to permit angular flexing as shown in FIG. 4.

The materials of construction used in this carrier 30 are very important for achieving the desired result. The belly plate 31, supporting rods, tubes or pipes 32 and 33, shoulder supports 36 and 37 and back bar 38 are rigid and made of a light metal such as aluminum, magnesium or titanium. The metal shoulder supports have the advantage that different sizes are readily accommodated.

Operation

The operation of this carrier should be apparent but will be described briefly for clarity. The carrier 30 is worn by the musician with the shoulder supports 36 and 37 positioned over the shoulders and the belly plate 31 supported against the abdomen. J-rods 45 are inserted in position and secured in place by tightening bolts 46. The short outer ends of the J-rods 45 are inserted into the J-rod receptacles on the percussion instrument being carried, e.g., drums (single or array), cymbals, xylophone, marimba, or the like.

The carrier is adjustable to the comfort of the wearer and also to fit different sized instruments. Clamp-receptacles 47 and 48 permit pivotal, lateral and angular adjustment of shoulder supports 36 and 37 on the out-turned ends 34 and 35 of rod or tube 33. Clamp-receptacles 39 and 40 permit vertical sliding adjustment of rod or tube 32. Slots 43 and 44 in belly plate 31 allow lateral adjustment of clamp-receptacles 41 and 42 and angular adjustment of J-rods 45 supported therein.

Figure 5:
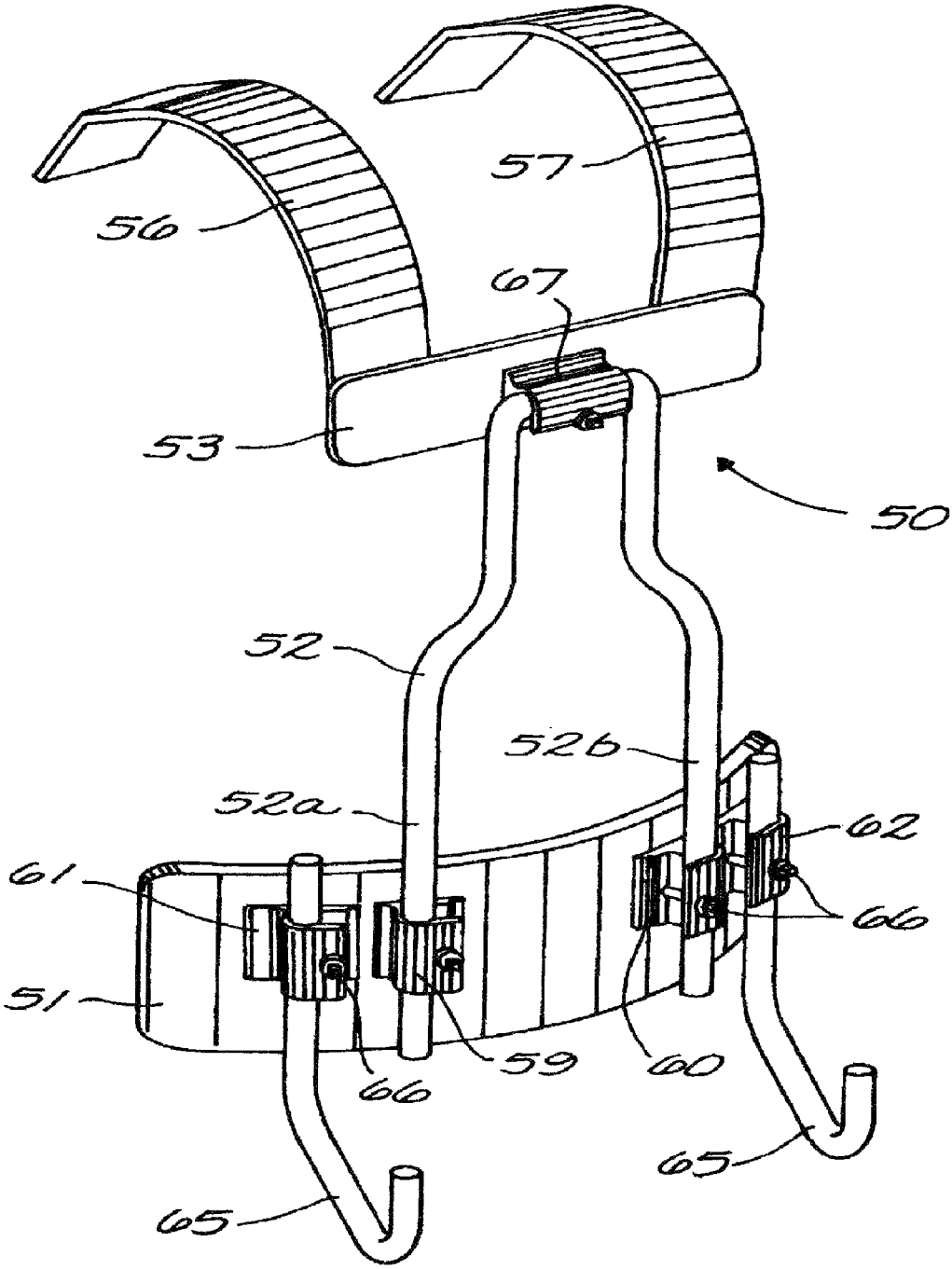
FIG. 5 is a front isometric view of an embodiment with the back bar removed.

Another Embodiment of Marching T-Bar Type Support for Drums and Other Percussion Instruments Referring to FIG. 5, there is shown a T-bar-type carrier 50 for percussion instruments which comprises a belly plate 51, an inverted U-shaped vertical supporting rod or tube 52. Rod or tube 52 has parallel portions 52*a* and 52*b* supporting belly plate 51. Rigid shoulder supports 56 and 57 are secured on bar 53.

Belly plate 51 is removably secured on the lower ends 52*a* and 52*b* of vertical rod or tube 52 by clamping receptacles 59 and 60. J-rod receptacles 61 and 62 are secured on belly plate 51. J-rods 65 are secured in receptacles 61 and 62 by bolts 66. The upper U-portion of supporting rod or tube 52 is supported in clamping receptacle 67 on bar 53 to support shoulder supports 56 and 57. The materials of construction used in this carrier 50 are very important for achieving the desired result. The belly plate 51, supporting rod or tube 52, and shoulder supports 56 and 57 are made of a light material such as plastic or a light metal such as aluminum, magnesium or titanium.

Operation

The operation of this carrier should be apparent but will be described briefly for clarity. The carrier 50 is worn by the musician with the shoulder supports 56 and 57 positioned over the shoulders and the belly plate 51 supported against the abdomen. J-rods 65 are inserted in position and secured in place by tightening bolts 66. The short outer ends of the J-rods 65 are inserted into the J-rod receptacles on the percussion instrument being carried, e.g., drums (single or array), cymbals, xylophone, marimba, or the like. The carrier is adjustable to comfort of the wearer and also to fit different sized instruments. Clamp-receptacle 67 permits pivotal adjustment of shoulder supports 56 and 57. Clamp-receptacles 59 and 60 permit vertical sliding adjustment of rod or tube 52. Clamp-receptacles 61 and 62 permit angular adjustment of J-rods 65.

Figures 6, 7:
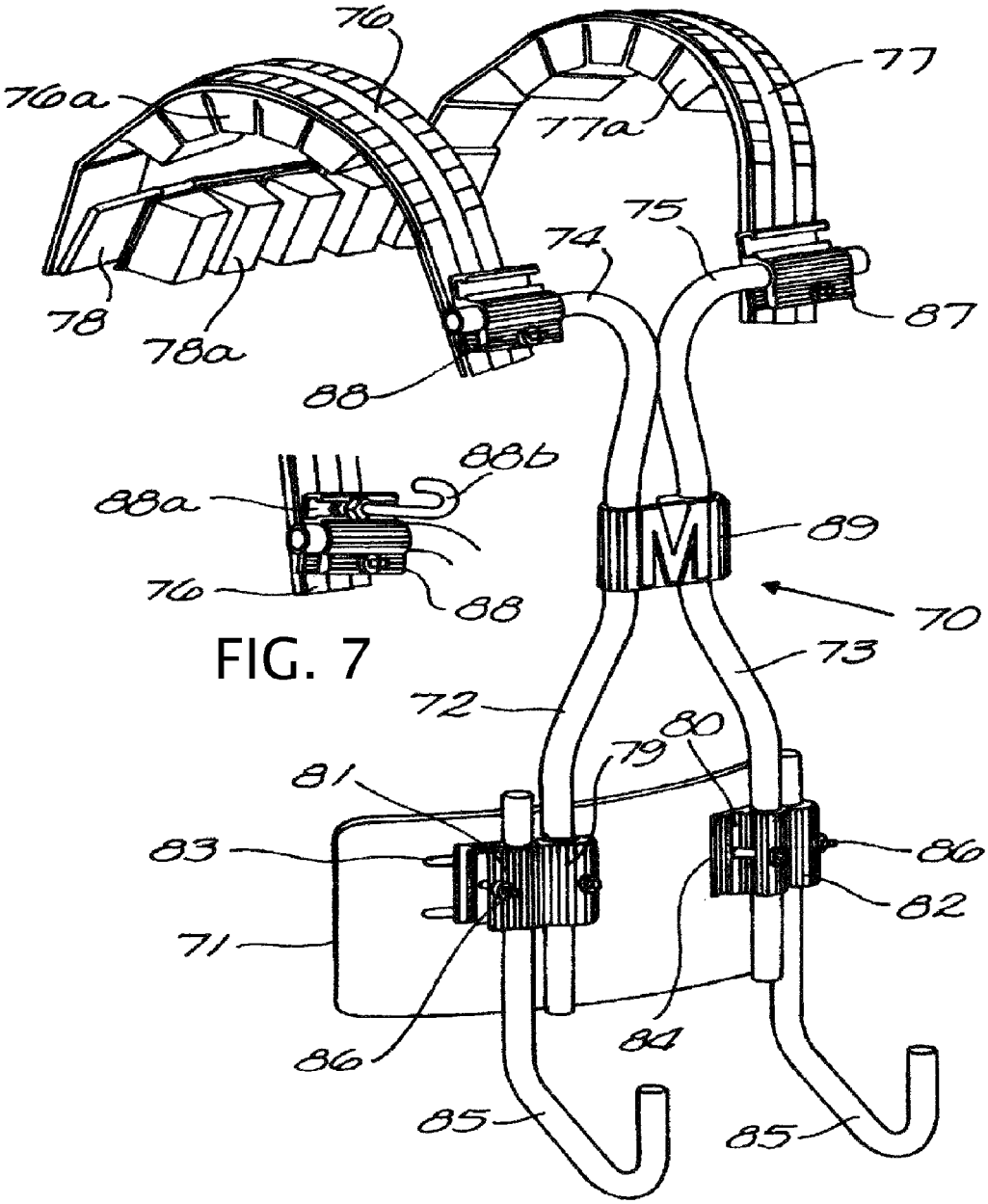
FIG. 6 is a front isometric view of supporting hardware with vertical and horizontal adjustability of the supports on the belly plate and adjustable shoulder supports and back bar
FIG. 7 is a detailed view of the tubular clamp form FIG. 6 with an optional J hook.

Another Embodiment of Marching T-Bar Type Support for Drums and Other Percussion Instruments Referring to FIGS. 6 and 7, there is shown a T-bar-type carrier 70 for percussion instruments which comprises a belly plate 71, vertical supporting rods, tubes or pipes 72 and 73 having out-turned portions 74 and 75 supporting rigid shoulder supports 76 and 77 and back bar 78. Back bar 78 may be removably secured to shoulder supports 78 or may be fixed as by welding or the like.

Belly plate 71 is removably secured on the lower ends of vertical rods, tubes or pipes 72 and 73 by clamping receptacles 79 and 80. J-rod receptacles 81 and 82 are secured on belly plate 71 in slots 83 and 84 by screws or bolts or the like. J-rods 85 are secured in receptacles 81 and 82 by bolts 86. The upper, out-turned ends 74 and 75 of supporting rods, tubes or pipes 72 and 73 are supported in clamping receptacles 87 and 88 on shoulder supports 76 and 77. A clamp or brace 89 holds rods, tubes or pipes 72 and 73 against lateral and or torque displacement.

Shoulder supports 76 and 77 and back bar 78 have cushions 76*a*, 77*a* and 78*a*, respectively. The cushions are of a type used to pad the interior of football and other sports helmets and are shown in more detail in the inventor's U.S. Pat. No. 6,028,257. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded. Clamp/receptacles 88 may have a retaining slot 88*a* which receives and supports an optional J-hook 85 (FIGS. 14 and 15) for connection to an upper part of a drum supported on carrier 70.

The materials of construction used in this carrier 70 are very important for achieving the desired result. The belly plate 71, vertical supporting rods, tubes or pipes 72 and 73, shoulder supports 76 and 77 and back bar 78 are rigid and made of a light material such as plastic or light metal such as aluminum, magnesium or titanium. The metal shoulder supports have the advantage that different sizes are readily accommodated.

Operation

The operation of this carrier should be apparent but will be described briefly for clarity. The carrier 70 is worn by the musician with the shoulder supports 76 and 77 positioned over the shoulders and the belly plate 71 supported against the abdomen. J-rods 85 are inserted in position and secured in place by tightening bolts 86. The short outer ends of the J-rods 85 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacles 87 and 88 permit pivotal, lateral and angular adjustment of shoulder supports 76 and 77 on the out-turned ends 74 and 75 of rods, tubes or pipes 72 and 73. Clamp-receptacles 79 and 80 permit vertical sliding adjustment of rods, tubes or pipes 72 and 73. Slots 83 and 84 in belly plate 71 allow lateral adjustment of clamp-receptacles 81 and 82 and angular adjustment of J-rods 85 supported therein.

Double Facing J-Rod Receptacles and Application

Figure 8:
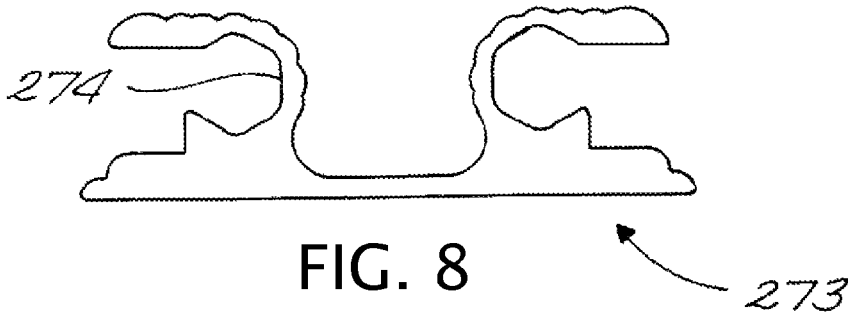
FIG. 8 is a view in end elevation of a novel double clamp for supporting a plurality of posts and/or J-rods.
Figure 9:
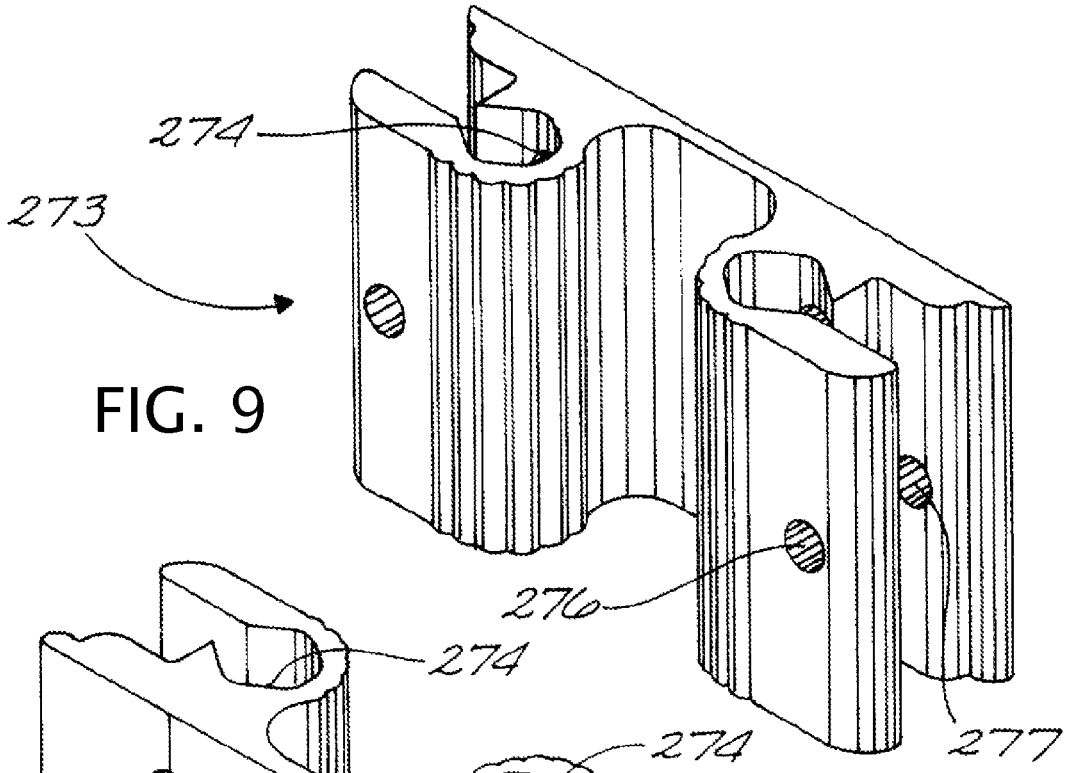
FIG. 9 is a front isometric view of the clamp shown in FIG. 8.
Figure 10:
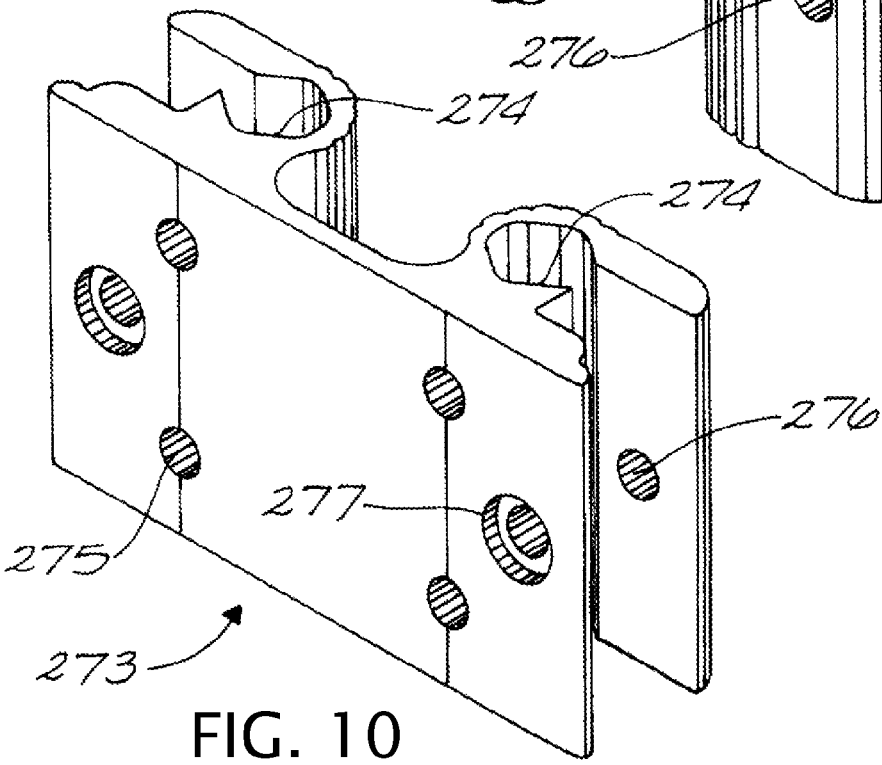
FIG. 10 is a rear isometric view of the clamp shown in FIG. 8.

In FIGS. 8, 9 and 10 there is shown a double facing receptacle for securing more than one J-rod or post. Receptacle 274 is cast or extruded and has a pair of open edge portions 274 facing in opposite directions which can flex to clamp J-rods or posts adjustably. Receptacles 273 have inner surfaces that provides for surfaces, which clamp the surface of the J-rods or posts.

This is a superior clamping arrangement to set screws that provide only one or two point clamping contact. Holes 275 in the base of each receptacle are used for mounting by means of bolts or screws or the like. Aligned holes 276, 277 receive clamping screws, which operate on adjustment to clamp, or to release the J-rod or post secured therein.

Figure 11:
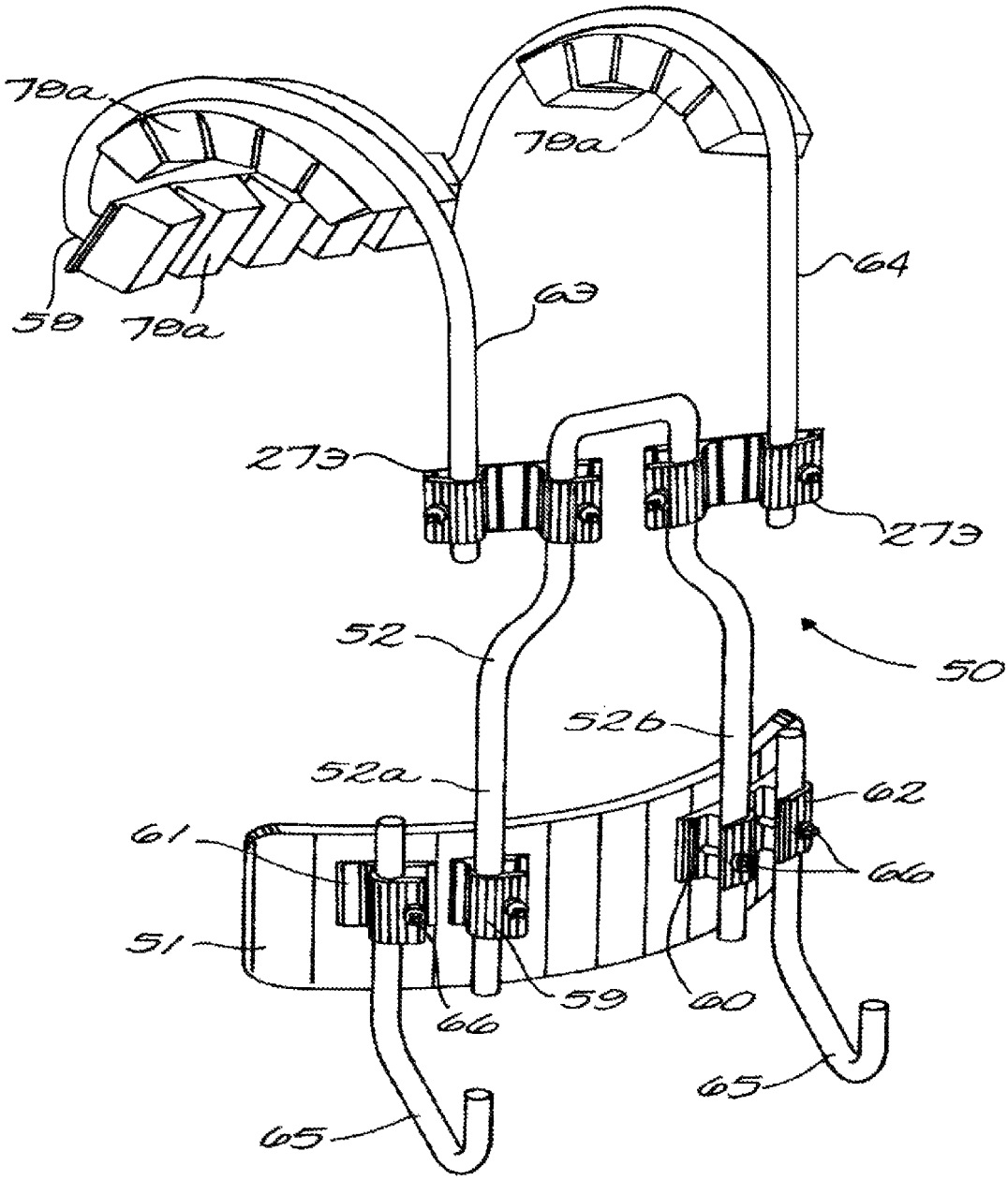
FIG. 11 is a front isometric view of supporting hardware with vertical and horizontal adjustability of the supports on the belly plate and adjustable shoulder member with a back bar.

Another Embodiment of Marching T-Bar Type Support for Drums and Other Percussion Instruments Referring to FIG. 11, there is shown a T-bar-type carrier 50 for percussion instruments which comprises a belly plate 51, an inverted U-shaped vertical supporting rod or tube 52. Rod or tube 52 has parallel portions 52*a* and 52*b* supporting belly plate 51. Rigid shoulder supports 56 and 57 are secured on bar 53.

Belly plate 51 is removably secured on the lower ends 52*a* and 52*b* of vertical rod or tube 52 by clamping receptacles 59 and 60. J-rod receptacles 61 and 62 are secured on belly plate 51. J-rods 65 are secured in receptacles 61 and 62 by bolts 66. The upper U-portion of supporting rod or tube 52 is supported in clamping receptacles 273. In the opposing side of clamping receptacles 273, a shoulder supporting member formed from one or a multiple of tube sections has shoulder tube sections 63, 64 and back member portion 58. The materials of construction used in this carrier 50 are very important for achieving the desired result. The belly plate 51, supporting rod or tube 52, and shoulder members 63, 64 and 58 are made of a light material such as plastic or a light metal such as aluminum, magnesium or titanium.

Shoulder and back member supports 63, 64 and 58 have cushions 78*a*, respectively. The cushions are of a type used to pad the interior of football and other sports helmets and are shown in more detail in the inventor's U.S. Pat. No. 6,028,257. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded.

Operation

The operation of this carrier should be apparent but will be described briefly for clarity. The carrier 50 is worn by the musician with the shoulder members 63 and 64 positioned over the shoulders and the belly plate 51 supported against the abdomen. J-rods 65 are inserted in position and secured in place by tightening bolts 66. The short outer ends of the J-rods 65 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacle 273 permits pivotal adjustment of shoulder members 63 and 64. Clamp-receptacles 59, 60 and 273 permit vertical sliding adjustment of rod or tube 52, 63 and 64. Clamp-receptacles 61 and 62 permit angular adjustment of J-rods 65.

Figure 12:
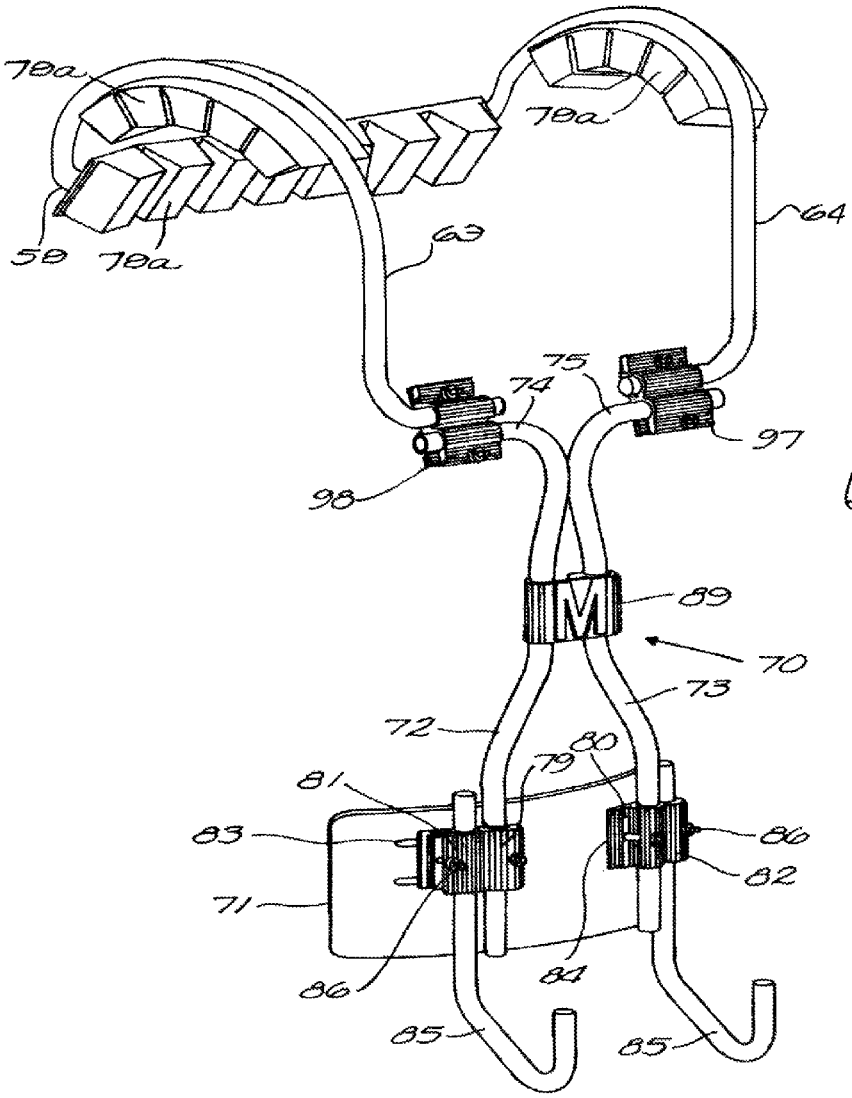
FIG. 12 is a front isometric view of supporting hardware with fore and aft shoulder adjustability of the shoulder supports with vertical adjustability on the belly plate.
Figure 12B:
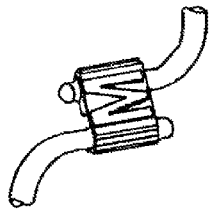
FIG. 12B shows an alternate tube bypass clamp to the shoulder supporting tube clamp shown in FIG. 12.

Another Embodiment of Marching T-Bar Type Support for Drums and Other Percussion Instruments FIG. 12 is a front isometric view of supporting hardware with fore and aft shoulder adjustability of the shoulder supports with vertical adjustability on the belly plate and FIG. 12B shows an alternate tube bypass clamp to the shoulder supporting tube clamp shown in FIG. 12.

Belly plate 71 is removably secured on the lower ends of vertical rods, tubes or pipes 72 and 73 by clamping receptacles 79 and 80. J-rod receptacles 81 and 82 are secured on belly plate 71 in slots 83 and 84 by screws or bolts or the like. J-rods 85 are secured in receptacles 81 and 82 by bolts 86. The upper, out-turned ends 74 and 75 of supporting rods, tubes or pipes 72 and 73 are supported in clamping receptacles 97 and 98 on shoulder supports 63 and 64. The clamping receptacles 97 and 98 can be loosened to provide adjustment to the shoulders as well as forward and aft adjustment of the shoulder positioning. Detailed views of these clamping receptacles 97 and 98 are shown and described in FIGS. 8, 9 and 10. An alternate clamping mechanisms is contemplated and shown in FIG. 12B using the joiner 49 from FIGS. 3 and 4. A clamp or brace 89 holds rods, tubes or pipes 72 and 73 against lateral and or torque displacement. It is further contemplated that rods, tubes or pipes 72, 73, support 89 and the upper tube clamps in 97 and 98 can be combined into a single unit with vertical adjustment on the abdomen or belly plate 71.

Shoulder supports 63, 64 and back bar 58 have cushions 78*a*, respectively. The cushions are of a type used to pad the interior of football and other sports helmets and are shown in more detail in the inventor's U.S. Pat. No. 6,028,257. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded. Clamp/receptacles 98 and 97 may have a retaining slot which receives and supports an optional J-hook 88*b* (FIG. 13) for connection to an upper part of a drum supported on carrier.

The materials of construction used in this carrier are very important for achieving the desired result. The belly plate 71, vertical supporting rods, tubes or pipes 72 and 73, shoulder supports 63 and 64 and back bar 58 are rigid and made of a light material such as plastic or a light metal such as aluminum, magnesium or titanium. The metal shoulder supports have the advantage that different sizes are readily accommodated.

Operation

The operation of this carrier should be apparent but will be described briefly for clarity. The carrier 70 is worn by the musician with the shoulder supports 63 and 64 positioned over the shoulders and the belly plate 71 supported against the abdomen. J-rods 85 are inserted in position and secured in place by tightening bolts 86. The short outer ends of the J-rods 85 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacles 97 and 98 permit pivotal, lateral, fore, aft and angular adjustment of shoulder supports 63 and 64 on the out-turned ends of rods, tubes or pipes. Clamp-receptacles 79 and 80 permit vertical sliding adjustment of rods, tubes or pipes 72 and 73. Slots 83 and 84 in belly plate 71 allow lateral adjustment of clamp-receptacles 81 and 82 and angular adjustment of J-rods 85 supported therein.

Figure 13:
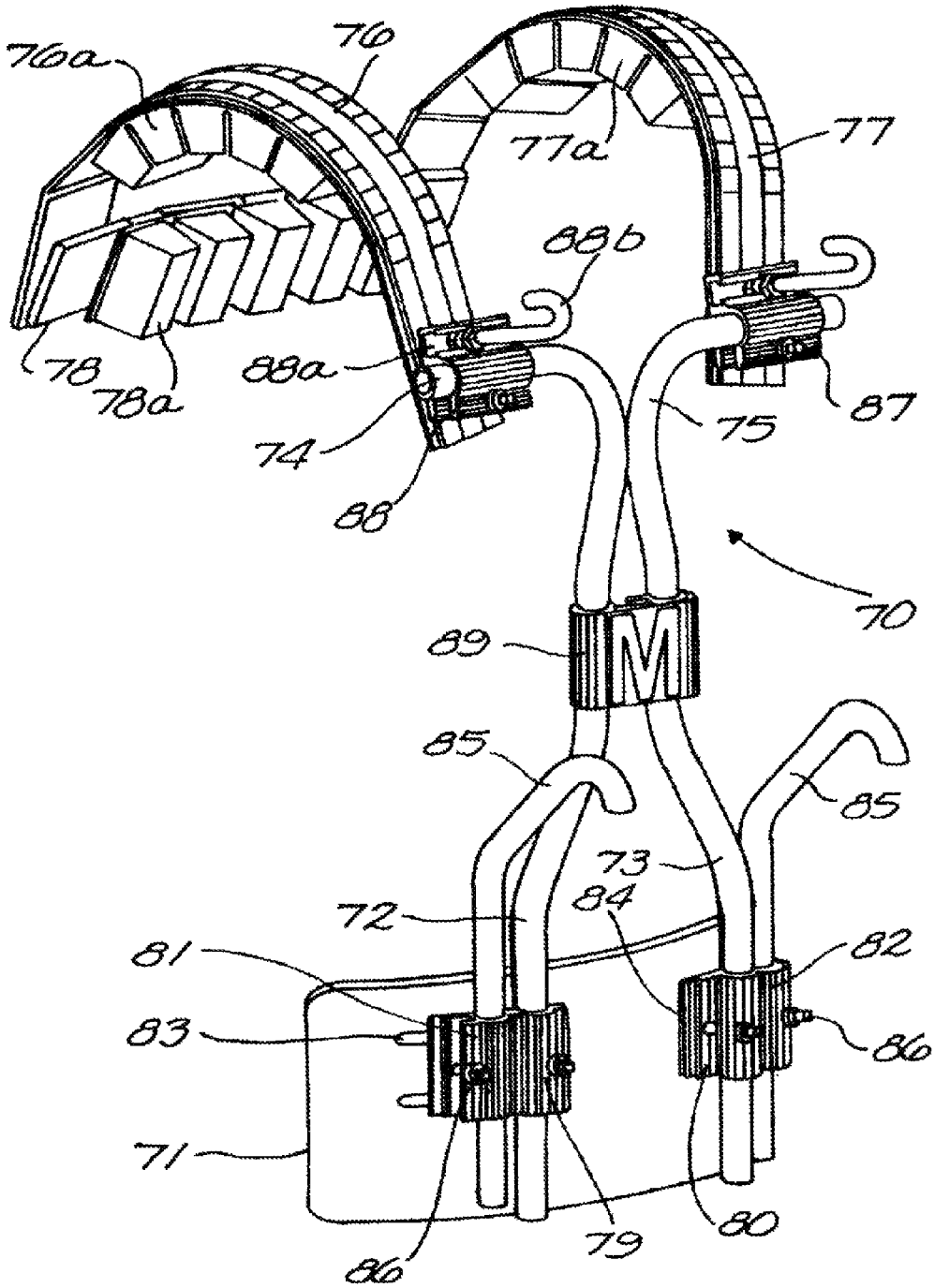
FIG. 13 is a front isometric view of the fully assembled carrier and supporting hardware with J-rods positioned in an inverted position for supporting the drum.
Figure 14:
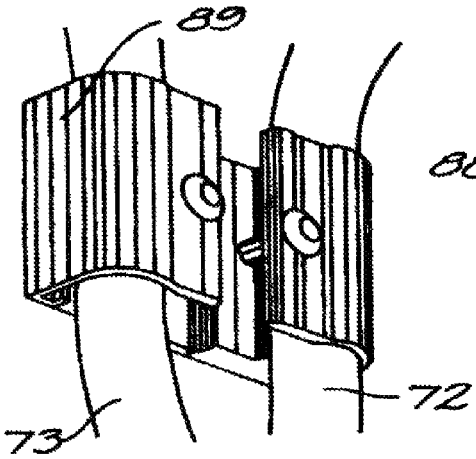
FIG. 14 is a detail isometric view of the clamp shown in FIG. 12 and FIG. 13 showing the connection of the vertical supporting rods and/or tubes.
Figure 15:
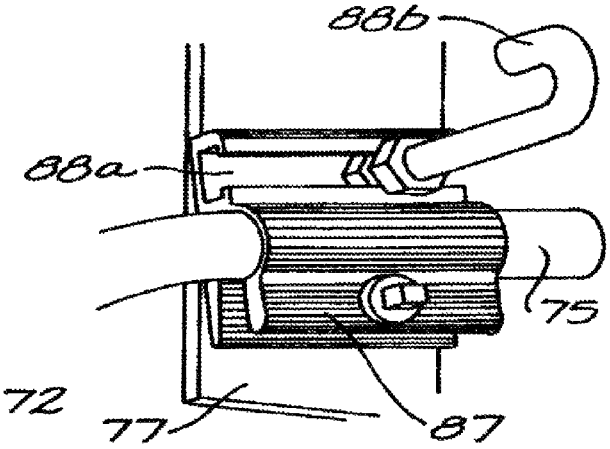
FIG. 15 is a detail isometric view of a clamp for the shoulder supports shown in FIG. 13.
Figure 16:
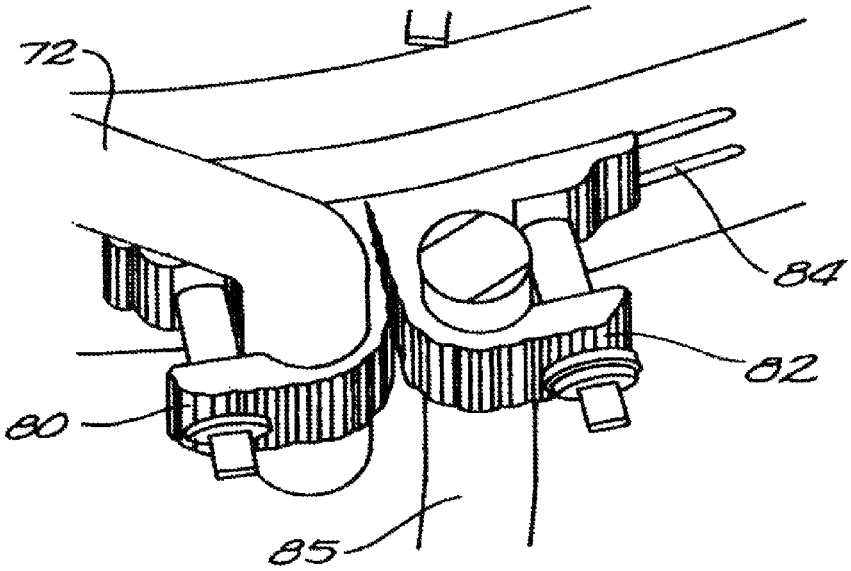
FIG. 16 is a detail isometric view of the bypass tube connection from FIG. 12 and FIG. 13.

Referring to FIG. 13, there is shown a T-bar-type carrier 70, as in FIGS. 1, 2, 5, 6 and 11, for percussion instruments which comprises a belly plate 71, vertical supporting rods, tubes or pipes 72 and 73 having out-turned portions 74 and 75 supporting rigid shoulder supports 76 and 77 and back bar 78. Back bar 78 may be removably secured to shoulder supports 78 or may be fixed as by welding or the like. Detail views of the clamping hardware are shown in FIGS. 14, 15 and 16.

Belly plate 71 is removably secured on the lower ends of vertical rods, tubes or pipes 72 and 73 by clamping receptacles 79 and 80. J-rod receptacles 81 and 82 are secured on belly plate 71 in slots 83 and 84 by screws or bolts or the like. J-rods 85 are secured in receptacles 81 and 82 by bolts 86. The upper, out-turned ends 74 and 75 of supporting rods, tubes or pipes 72 and 73 are supported in clamping receptacles 87 and 88 on shoulder supports 76 and 77. J-hooks 88*b* are installed in slots 88*a* on receptacle/clamp 88 and the J-rods 85 are inverted for a different drum being supported thereon. A clamp or brace 89 holds rods, tubes or pipes 72 and 75 against lateral and or torque displacement.

Shoulder supports 76 and 77 and back bar 78 have cushions 76*a*, 77*a* and 78*a*, respectively. The cushions are of a type used to pad the interior of football and other sports helmets and are shown in more detail in the inventor's U.S. Pat. No. 6,028,257. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded. Clamp/receptacles 88 may have a retaining slot 88*a* which receives and supports an optional J-hook 88*b* (FIG. 7) for connection to an upper part of a drum supported on carrier 70.

The materials of construction used in this carrier 70 are very important for achieving the desired result. The belly plate 71, vertical supporting rods, tubes or pipes 72 and 73, shoulder supports 76 and 77 and back bar 78 are rigid and made of a light material such as plastic or a light metal such as aluminum, magnesium or titanium. The metal shoulder supports have the advantage that different sizes are readily accommodated.

Operation

The operation of this carrier should be apparent but will be described briefly for clarity. The carrier 70 is worn by the musician with the shoulder supports 76 and 77 positioned over the shoulders and the belly plate 71 supported against the abdomen. J-rods 85 are inserted in position and secured in place by tightening bolts 86. The short outer ends of the J-rods 85 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacles 87 and 88 permit pivotal, lateral and angular adjustment of shoulder supports 76 and 77 on the out-turned ends 74 and 75 of rods, tubes or pipes 72 and 73. Clamp-receptacles 79 and 80 permit vertical sliding adjustment of rods, tubes or pipes 72 and 73. Slots 83 and 84 in belly plate 71 allow lateral adjustment of clamp-receptacles 81 and 82 and angular adjustment of J-rods 85 supported therein.

Figure 17:
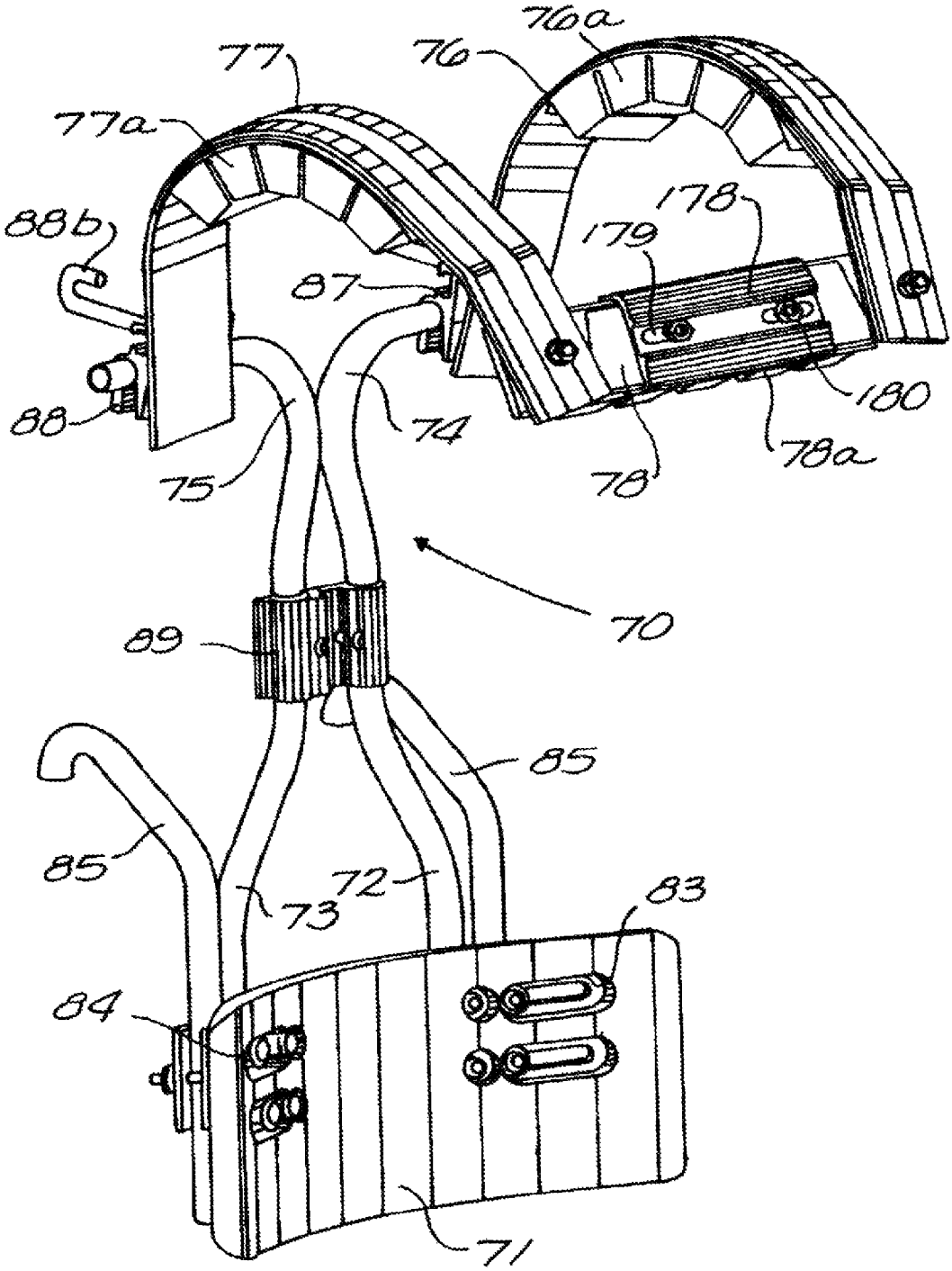
FIG. 17 is a rear isometric view of the embodiment of FIG. 13.

Referring to FIG. 17, there is shown a T-bar-type carrier 70, as in FIGS. 1, 2, 5, 6, 11, 12 and 13, for percussion instruments which comprises a belly plate 71, vertical supporting rods, tubes or pipes 72 and 73 having out-turned portions 74 and 75 supporting rigid shoulder supports 76 and 77 and back bar 78. Back bar 78 may be removably secured to shoulder supports 78 or may be fixed as by welding or the like.

Belly plate 71 is removably secured on the lower ends of vertical rods, tubes or pipes 72 and 73 by clamping receptacles 79 and 80. J-rod receptacles 81 and 82 are secured on belly plate 71 in slots 83 and 84 by screws or bolts or the like. J-rods 85 are secured in receptacles 81 and 82 by bolts 86. The upper, out-turned ends 74 and 75 of supporting rods, tubes or pipes 72 and 73 are supported in clamping receptacles 87 and 88 on shoulder supports 76 and 77. J-hooks 88*b* are installed in slots 88*a* on receptacle/clamp 88 and the J-rods 85 are inverted for a different drum being supported thereon. A clamp or brace 89 holds rods, tubes or pipes 72 and 73 against lateral and or torque displacement.

Shoulder supports 76 and 77 and back bar 78 have cushions 76*a*, 77*a* and 78*a*, respectively. The cushions are of a type used to pad the interior of football and other sports helmets and are shown in more detail in the inventor's U.S. Pat. No. 6,028,257. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded. Clamp/receptacles 88 may have a retaining slot 88*a* which receives and supports an optional J-hook 88*b* (FIG. 7) for connection to an upper part of a drum supported on carrier 70.

The materials of construction used in this carrier 70 are very important for achieving the desired result. The belly plate 71, vertical supporting rods, tubes or pipes 72 and 73, shoulder supports 76 and 77 and back bar 78 are rigid and made of a light material such as plastic or a light metal such as aluminum, magnesium or titanium. The metal shoulder supports have the advantage that different sizes are readily accommodated.

Operation

The operation of this carrier should be apparent but will be described briefly for clarity. The carrier 70 is worn by the musician with the shoulder supports 76 and 77 positioned over the shoulders and the belly plate 71 supported against the abdomen. J-rods 85 are inserted in position and secured in place by tightening bolts 86. The short outer ends of the J-rods 85 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacles 87 and 88 permit pivotal, lateral and angular adjustment of shoulder supports 76 and 77 on the out-turned ends 74 and 75 of rods, tubes or pipes 72 and 73. Clamp-receptacles 79 and 80 permit vertical sliding adjustment of rods, tubes or pipes 72 and 73. Slots 83 and 84 in belly plate 71 allow lateral adjustment of clamp-receptacles 81 and 82 and angular adjustment of J-rods 85 supported therein.

Figure 18:
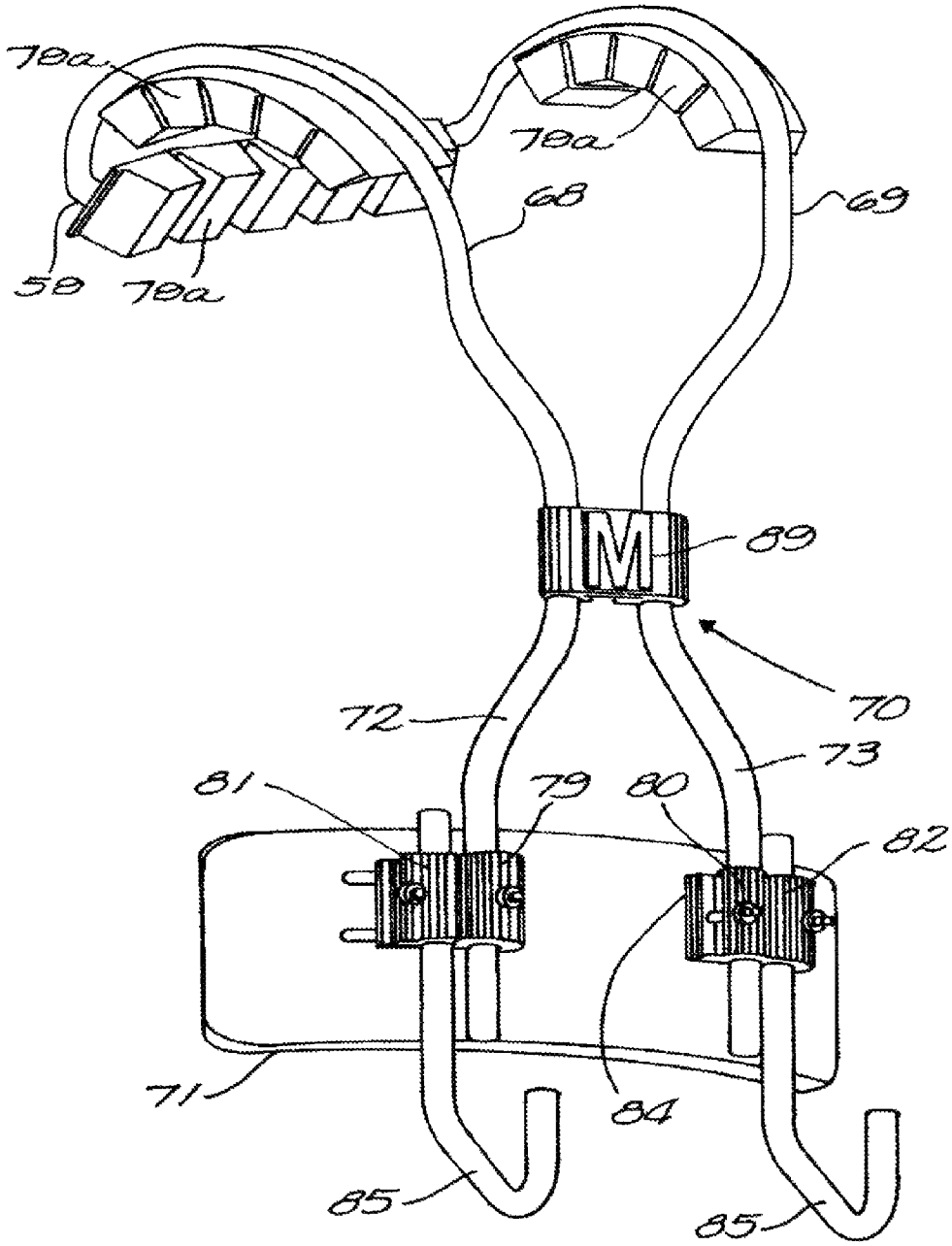
FIG. 18 is an isometric view of another embodiment of the invention shown in FIGS. 1, 2 and 6 in which the shoulder supports connect with the abdominal belly plate.

Another Embodiment of Marching T-Bar Type Support for Drums and Other Percussion Instruments Referring to FIG. 18, there is shown a T-bar-type carrier 70, as in FIGS. 1, 2, 5, 6, 11, 12, 13 and 17, for percussion instruments which comprises a belly plate 71, vertical supporting rods, tubes or pipes 72 and 73 supporting shoulder tubes or rods 68 and 69 with back bar 58. Back bar 58 may be removably secured to shoulder rod, tube or pipes 68 and 69 or may be formed from a single piece or rod, tube or pipe or fabricated to telescope together or formed from a welded or fabricated assembly.

Belly plate 71 is removably secured on the lower ends of vertical rods, tubes or pipes 72 and 73 by clamping receptacles 79 and 80. J-rod receptacles 81 and 82 are secured on belly plate 71 in slots 84 by screws or bolts or the like. J-rods 85 are secured in receptacles 81 and 82 by bolts. A clamp or brace 89 holds rods, tubes or pipes 72/68 and 73/69 against lateral and or torque displacement.

Shoulder rods, tubes or pipes 68 and 69 and back tube, rod or bar 58 have cushions 7 78*a*. The cushions 78*a* are of a type used to pad the interior of football and other sports helmets and are shown in more detail in the inventor's U.S. Pat. No. 6,028,257. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded.

The materials of construction used in this carrier 70 are very important for achieving the desired result. The belly plate 71, vertical supporting rods, tubes or pipes 72/68 and 73/69 and back tube, rod or member 58 are rigid and made of a light material such as plastic or a light metal such as aluminum, magnesium or titanium.

Operation

The operation of this carrier should be apparent but will be described briefly for clarity. The carrier 70 is worn by the musician with the shoulder tubes, rods or supports 68 and 69 positioned over the shoulders and the belly plate 71 supported against the abdomen. J-rods 85 are inserted in position and secured in place by tightening bolts 86. The short outer ends of the J-rods 85 are inserted into the J-rod receptacles on the percussion instrument being carried, e.g., drums (single or array), cymbals, xylophone, marimba, or the like.

Another Embodiment with Adjustably Positioned J-Rod Clamps

Figure 19:
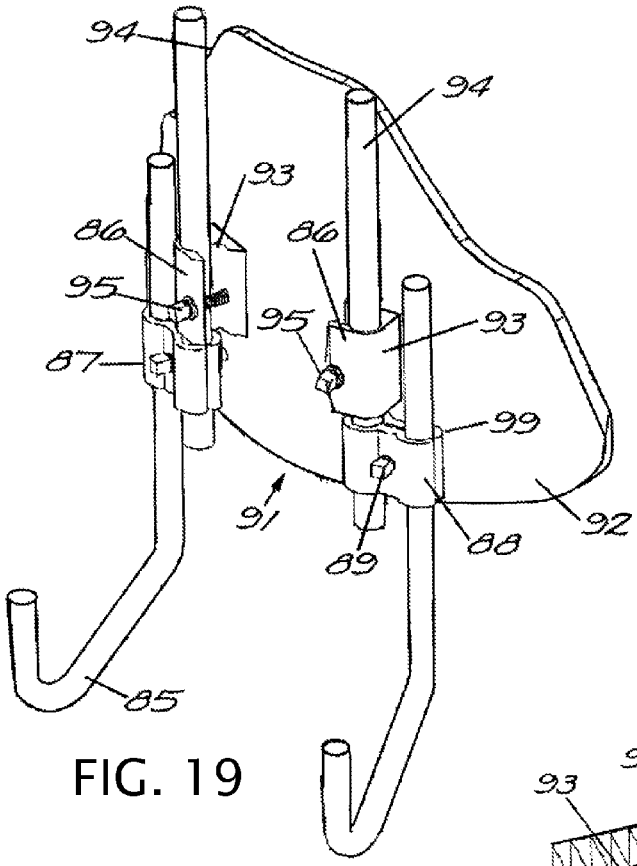
FIG. 19 is a front isometric view of the fully assembled carrier and supporting clamp with J-rods positioned in a normal position for supporting the drum and having a double clamp for the supporting base permitting longitudinal and rotary adjustment in position of the clamp.
Figure 20:
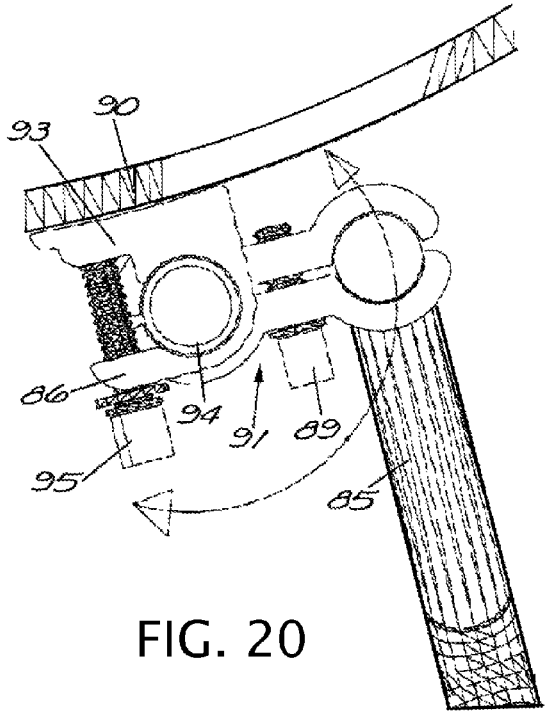
FIG. 20 is an end view of the clamp shown in FIG. 18.

Referring to FIGS. 19 and 20, there is shown a vest- or T-bar-type carrier 91 for percussion instruments, which comprises a vest portion or belly plate portion 90 having two pairs of receptacles 93 secured thereon by screws or bolts. Supporting tubes 94 are supported in receptacles 93 and secured in position by square head bolts 95, which may be operated by a drum key (not shown).

Receptacles 93 are cast or extruded and have an open edge portion 86, which can flex to clamp tubes 94 adjustably Receptacles 93 have an inner surface that is non-circular, e.g., polygonal, serrated, or the like, which provides a plurality of surfaces, which clamp the surface of the tubes 94. This is a superior clamping arrangement to set screws that provide only one or two point clamping contact.

Two part tube clamps 87 have mating portions 88 and 99 secured together to clamp tube 94 and J-rods 85. Aligned holes in mating portions 88 and 99 receive square headed bolts, which are operated by a drum key to clamp or to release the tube 94 and J-rod 85.

Operation

The operation of this carrier should be apparent but will be described briefly for clarity. The carrier 91 is worn by the musician with the vest or belly plate 92 supported against his abdomen. Receptacle bases 93 are secured on vest or belly plate 92. Square-headed bolts 95 secure supporting tubes 94 for longitudinal adjustment of position therein. Square-headed bolts are operated to clamp two part clamp 87 around J-rod 85 or tube 94. This construction permits independent vertical adjustment of J-rod 100 and rotary movement of the J-rod on supporting tube 94.

Marching Vest-Type Support for Drums and Other Percussion Instruments

Figure 21:
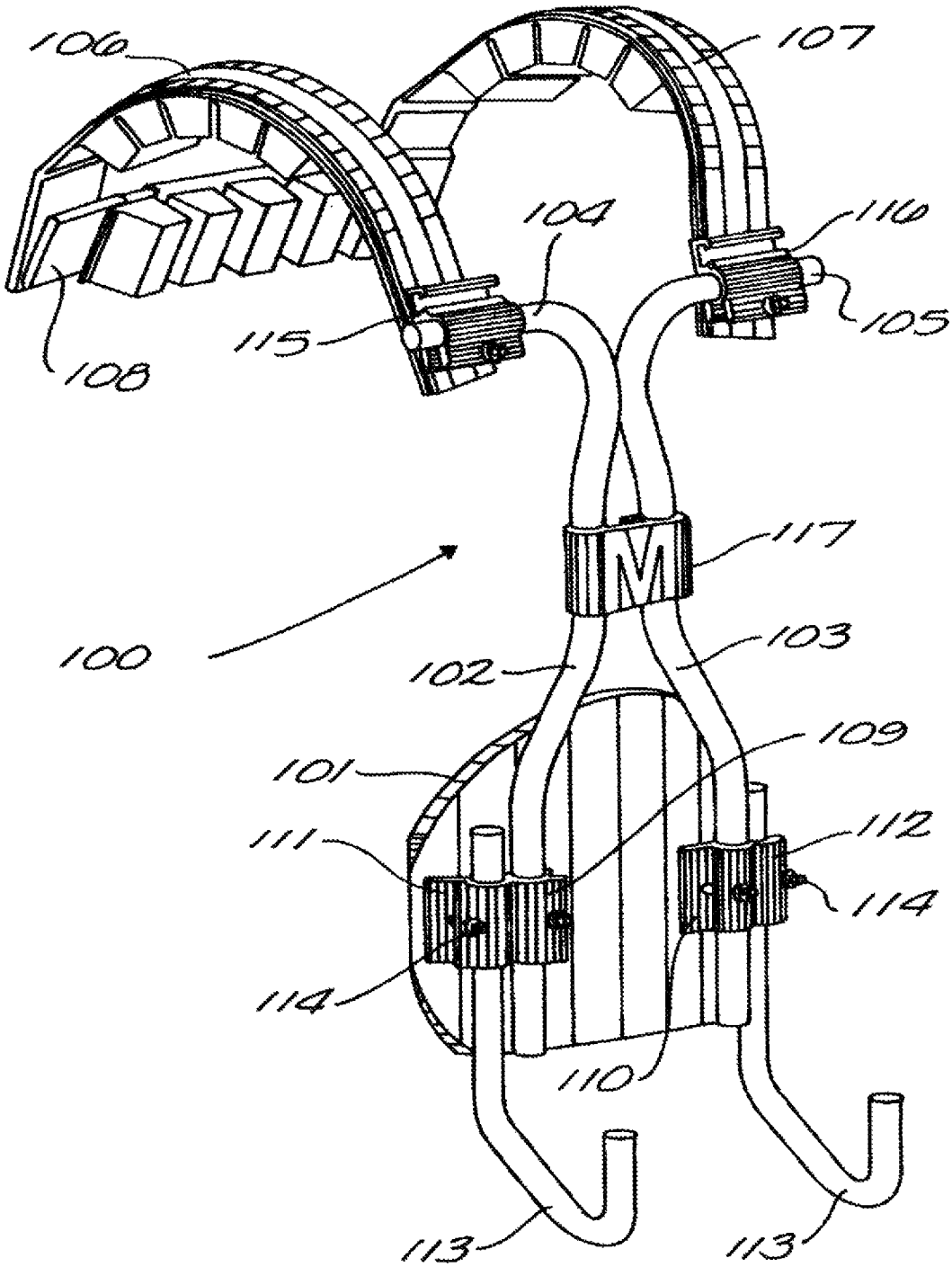
FIG. 21 is an isometric view of another embodiment of the invention shown in FIGS. 1 and 2 in which the abdominal belly plate is replaced by a vest-type support.

Referring to FIG. 21, there is shown a vest-type carrier 100 for percussion instruments which comprises a vest 101, vertical supporting rods, tubes or pipes 102 and 103 having outturned portions 104 and 105 supporting rigid shoulder supports 106 and 107 and back bar 108. Back bar 108 may be removably secured to shoulder supports 106 and 107 or may be fixed as by welding or the like.

Vest 101 is removably secured on the lower ends of vertical rods, tubes or pipes 102 and 103 by clamping receptacles 109 and 110. J-rod receptacles 111 and 112 may be secured on vest plate 101 in slots by screws or bolts or the like. J-rods 113 are secured in receptacles 111 and 112 by bolts 114. The upper, out-turned ends 104 and 105 of supporting rods, tubes or pipes 102 and 103 are supported in clamping receptacles 115 and 116 on shoulder supports 106 and 107. A clamp 117 holds rods, tubes or pipes 102 and 103 against lateral and or torque displacement.

The materials of construction used in this carrier 100 are very important for achieving the desired result. The vest 101, vertical supporting rods, tubes or pipes 102 and 103, shoulder supports 106 and 107 and back bar 108 are rigid and made of a light material such as plastic or a light metal such as aluminum, magnesium or titanium. The metal shoulder supports have the advantage that different sizes are readily accommodated.

Operation

The operation of this carrier should be apparent but will be described briefly for clarity. The carrier 100 is worn by the musician with the shoulder supports 106 and 107 positioned over the shoulders and the vest 101 supported against the abdomen and chest. J-rods 113 are inserted in position and secured in place by tightening bolts 114. The short outer ends of the J-rods 113 are inserted into the J-rod receptacles on the percussion instrument being carried, e.g., drums (single or array), cymbals, xylophone, marimba, or the like.

The carrier is adjustable to comfort of the wearer and also to fit different sized instruments. Clamp-receptacles 115 and 116 permit pivotal, lateral and angular adjustment of shoulder supports 106 and 107 on the out-turned ends 104 and 105 of rods, tubes or pipes 102 and 103. Clamp-receptacles 109 and 110 permit vertical sliding adjustment of rods, tubes or pipes 102 and 103. Slots in vest 101 allow lateral adjustment of clamp-receptacles 111 and 112 and angular adjustment of J-rods 113 supported therein.

Thus, specific embodiments of a rod or tubular shoulder supported carrier for percussion instruments have been disclosed. Moreover, the described implementations of the invention are susceptible to various modifications and alternative constructions. It should be understood, that there is no intention to limit the invention to the specific form or forms disclosed, but on the contrary, the intention is to cover all modifications, alternative constructions, and equivalents falling within the spirit and scope of the invention.

The invention claimed is:

1. A vertically adjustable shoulder supported harness assembly for supporting percussion musical instruments, comprising:

an upper support section comprising at least two shoulder supporting members for securing said section on the shoulders of a user wherein;

said at least two shoulder supporting members extend over the shoulders of a user during use and connect in front of said user with at least one rod, or tube or pipe clamp(s) or brace(s) defining any one of a "U" shape, or "Y" shape, or "V" shape or a combination thereof;

a back support joining said upper support section wherein;

said back support is connected to said user from a connection by way of said at least two shoulder supporting members over shoulders of said user;

a lower support section including structure for supporting musical instruments, and means for vertical adjustment on or between said upper support section or said lower support section.

2. The vertically adjustable shoulder supporting harness assembly for supporting percussion musical instruments as defined in claim 1 wherein said front connecting rod, tube or pipe transition into said at least two shoulder supporting members and said back support thereby forming said upper support section.

3. The vertically adjustable shoulder supporting harness assembly for supporting percussion musical instruments as defined in claim 1 wherein said lower support section includes an attachment means for at least two "J" rods, or "J" tubes or "J" pipes, said at least two "J" rods, or "J" tubes or "J" pipes being independently adjustable in said attachment means and independent from said vertical adjustment.

4. The vertically adjustable shoulder supporting harness assembly for supporting percussion musical instruments as defined in claim 1 wherein said vertical adjustment connects said upper support section to said lower support section comprises at least one rod, or one tube, or one pipe, or one post, or one bar, or one plate, or one extrusion.

5. The vertically adjustable shoulder supporting harness assembly for supporting percussion musical instruments as defined in claim 1 wherein said vertically adjustable connection provides for infinite connection positions along a clamping length of said rods, tubes or pipes.

6. The vertically adjustable shoulder supporting harness assembly for supporting percussion musical instruments as defined in claim 1 that further includes at least one elongated slot or track for guided vertical movement between said upper support section and said lower support section.

7. The vertically adjustable shoulder supported harness assembly for supporting percussion musical instruments as defined in claim 1 that further includes padding located between said user and a rod, tube, pipe, post, plate support or extrusion.

8. The vertically adjustable shoulder supporting harness assembly for supporting percussion musical instruments as defined in claim 1 wherein said at least two shoulder supporting members further includes at least one clamp located between said lower support section and shoulders of said wearer to reduce lateral and or torque displacement of said at least two shoulder supporting members.

9. The vertically adjustable shoulder supporting harness assembly for supporting percussion musical instruments as defined in claim 1 wherein said upper section extends from said lower support section over each shoulder of a user and connects behind said user.

10. A shoulder supported harness assembly for supporting percussion instruments, comprising:

an abdomen supporting member resting against the abdominal region of the wearer in use, said abdomen supporting member having a first set of at least one rod, or tube, or pipe retaining member secured thereon for supporting drum hardware;

a shoulder supporting member secured with at least a second rod, or tube, or pipe retaining member wherein said shoulder supporting member extends over each shoulder of a user to suspend said abdomen supporting member in an abdomen region of a wearer, and said abdomen supporting member is vertically adjustable relative to said shoulder supporting member.

11. The shoulder supported harness assembly for supporting percussion instruments according to claim 10, in which said drum supporting hardware is a J-rod, or a J-tube, or a J-bar or a J-pipe supported in receptacles that is retained on said first set of at least one rod, or tube or pipe retaining member.

12. The shoulder supported harness assembly for supporting percussion instruments according to claim 10 that further includes a back member between said shoulder supporting member for contacting the back of the wearer.

13. The shoulder supported harness assembly for supporting percussion instruments according to claim 12 wherein said back member and or said shoulder supporting member is adjustable.

14. The shoulder supported harness assembly for supporting percussion instruments according to claim 10 wherein said abdomen supporting member is independently adjustable from said drum supporting hardware.

15. The shoulder supported harness assembly for supporting percussion instruments according to claim 10 wherein said at least one shoulder supporting member comprises at least one rod, or one tube, or one pipe, or one post, or one bar, or one plate, or one extrusion.

16. The shoulder supported harness assembly for supporting percussion instruments according to claim 15 wherein said at least one shoulder supporting member further include at least one clamp located between said abdomen supporting member and said shoulders of said wearer to provide lateral displacement of said shoulder supporting member.

17. The shoulder supported harness assembly for supporting percussion instruments according to claim 10 that further includes a back member spanning between said shoulder supports of said shoulder supporting member.

18. The shoulder supported harness assembly for supporting percussion instruments according to claim 17 wherein said shoulder supporting member and or said back member further includes a cushion or pad.

19. The shoulder supported harness assembly for supporting percussion instruments according to claim 10 wherein said shoulder supporting member is adjustable to rotate said shoulder supporting member or move towards and or away from said abdomen supporting member.

20. The shoulder supported harness assembly for supporting percussion instruments according to claim 10 wherein said abdomen supporting member integrates with said shoulder supporting member.

* * * * *